US005147751A

United States Patent [19]

Kojima et al.

[11] Patent Number: 5,147,751

[45] Date of Patent: Sep. 15, 1992

[54] ELECTROPHOTOGRAPHIC PHOTOCONDUCTOR AND ELECTROPHOTOGRAPHIC COPYING PROCESS AND APPARATUS USING THE PHOTOCONDUCTOR

[75] Inventors: Narihito Kojima; Hiroshi Nagame, both of Numazu; Mitsuru Seto, Kanagawa; Takashi Rokutanzono; Shinji Nousho, both of Numazu, all of Japan

[73] Assignee: Ricoh Company, Ltd., Tokyo, Japan

[21] Appl. No.: 780,454

[22] Filed: Oct. 22, 1991

Related U.S. Application Data

[63] Continuation of Ser. No. 459,348, Dec. 29, 1989, abandoned.

[30] Foreign Application Priority Data

Jan. 13, 1989 [JP] Japan ..... 1-4745
Oct. 12, 1989 [JP] Japan ..... 1-263815

[51] Int. Cl.[5] ..... G03G 13/22
[52] U.S. Cl. ..... 430/125; 430/97
[58] Field of Search ..... 430/97, 125

[56] References Cited

U.S. PATENT DOCUMENTS 3,526,457 9/1970 Dimond et al. ..... 430/125 X
4,279,500 7/1981 Kondo et al. ..... 355/15
4,931,841 6/1990 Yoshihara ..... 430/58 X

FOREIGN PATENT DOCUMENTS 2917015 11/1979 Fed. Rep. of Germany ..... 430/125
63-291063 11/1988 Japan ..... 430/66

*Primary Examiner*—Roland Martin
*Attorney, Agent, or Firm*—Oblon, Spivak, McClelland, Maier & Neustadt

[57] ABSTRACT

An electrophotographic photoconductor comprises (a) an electroconductive support, (b) a photoconductive layer formed thereon comprising a selenium alloy, and (c) a protective layer which is formed on the photoconductive layer, contains a binder resin component and an anti-oxidizing agent. In an electrophotographic copying process and an electrophographic copying apparatus using this photoconductor, the protective layer is abraded at a predetermined rate during the copying process in such a fashion that the anti-oxidizing agent contained in the protective layer is always present at the surface of the protective layer, thereby protecting the photoconductor from ozone and ions which are generated during corona charging of the photoconductor.

9 Claims, 2 Drawing Sheets

ELECTROPHOTOGRAPHIC PHOTOCONDUCTOR AND ELECTROPHOTOGRAPHIC COPYING PROCESS AND APPARATUS USING THE PHOTOCONDUCTOR

This application is a continuation of application Ser. No. 07/459,348, filed on Dec. 29, 1989, now abandoned.

BACKGROUND OF THE INVENTION

1. Field of the Invention

The present invention relates to an electrophotographic photoconductor comprising a photoconductive layer of a selenium alloy and a protective layer formed thereon containing an anti-oxidizing agent, and an electrophotographic copying process and an apparatus using the particular electrophographic photoconductor.

2. Discussion of Background

Conventionally, a variety of electrophotographic photoconductors are known. For instance, there are known an electrophotographic photoconductor in which a photoconductive layer consisting essentially of selenium or a selenium alloy is formed on an electroconductive support; an electrophotographic photoconductor prepared by dispersing an inorganic photoconductive material, such as zinc oxide or cadmium sulfide, in a binder agent and coating the dispersion on an electroconductive support; and an electrophotographic photoconductor comprising a photoconductive layer which contains an organic photoconductive material such as a mixture of poly-N-vinylcarbazole and trinitrofluorenone, an azo pigment or amorphous silicon.

Recently a demand for an electrophotographic photoconductor having high reliability, capable of producing high quality images for a long period of time is increasing. In the case of an electrophotographic photoconductor with its photoconductive layer unprotected and exposed, the photoconductive layer is gradually damaged by corona charges applied thereto in the course of a charging process. Furthermore the photoconductive layer is physically and chemically deteriorated in a copying process while it is brought into contact with other members of an electrophotographic copying apparatus. There are the main factors for shortening the life of the electrophotographic photoconductor.

To solve the above-mentioned problem, methods of covering the surface of an electrophotographic photoconductor with a protective layer are known. More specifically, there are disclosed a method of forming an organic film on the surface of a photoconductive layer of an electrophotographic photoconductor in Japanese Patent Publication 38-015446; a method of providing an inorganic oxide layer on the surface of a photoconductive layer in Japanese Patent Publication 43-014517; a method of successively overlaying an adhesive layer and an insulating layer on a photoconductive layer in Japanese Patent Publication 43-027591; and methods of laminating an amorphous silicon (a-Si) layer, a-Si:N:H layer or a-Si:O:H layer on a photoconductive layer by the plasma CVD or the photo CVD in Japanese Laid-Open Patent Applications 57-179859 and 59-058437.

However, when the above-mentioned protective layers have a resistivity of $10^{14}$ Ω·cm or more, which is considered to be too high in electrophotography, the residual potential of the photoconductor increases while in use, and the residual electric charges are gradually accumulated during the repetition of copying operation, which will hinder the practical operation of the photoconductor.

In order to cover the above-mentioned shortcoming of the protective layer, there is proposed in Japanese Patent Publication 52-024414 a method of optimizing the resistivity of a protective layer by adjusting the composition of a resin contained in the protective layer. Furthermore, methods of forming a photoconductive protective layer on a photoconductive layer are proposed, as disclosed in Japanese Patent Publications 48-038427, 43-016198 and 49-010258, and U.S. Pat. No. 2,901,348. In addition, there are disclosed a method of adding to a protective layer sensitizers such as dyes and charge transporting agents represented by Lewis acids, as in Japanese Patent Publication 44-000834 and Japanese Laid-Open Patent Application 53-133444; and a method of controlling the resistivity of a protective layer by adding finely-divided particles of metals or metallic oxides, as in Japanese Laid-Open Patent Application 53-003338.

When the particles of metals or metallic oxides are added to the protective layer, projected light for image formation is partially absorbed in the protective layer while passing therethrough. As a result, the amount of the light which reaches the photoconductive layer is decreased and accordingly the photosensitivity of the photoconductor is disadvantageously decreased.

To eliminate the above-mentioned disadvantage, there is further proposed in Japanese Laid-Open Patent Application 57-030546 a method of making a protective layer which is substantially transparent to visible light by dispersing in a protective layer metallic oxide particles having an average particle diameter of 0.3 μm or less, which serve as a resistivity-controlling agent.

In the photoconductor provided with the above-mentioned protective layer, the reduction in the photosensitivity can be minimized, and the mechanical strength of the protective layer can be increased so that the resistance to wear can be remarkably improved.

However, it is found that the above-mentioned photoconductor has a problem that image flow occurs. Namely, blurred images are formed when the photoconductor is used repeatedly in a copying machine for an extended period of time under the conditions of high humidities or in the atmosphere where the ambient humidity drastically increases. The cause of such a phenomenon has not yet been clarified, but it is supposed that a resin contained in the protective layer is oxidized and deteriorated by ozone or various ions which are generated by corona charges applied to the photoconductor while it is repeatedly used. As a result, the resin is fractured or some radicals are formed. In addition to the above, the ozone and ions generated by the corona discharging of the photoconductor react with water and impurities such as a carbon dioxide gas in the air, so that nitrogen compounds and hydrophilic compounds containing carboxyl groups and aldehyde groups are formed. Those compounds are chemically adsorbed by deteriorated portions at the surface of the protective layer. When the photoconductor is operated under the conditions of high humidities or drastically increasing humidities, the protective layer of the photoconductor adsorbs a large amount of moisture, and the resistivity of the surface of the photoconductor is so much decreased that the image flow problem will occur in the photoconductor.

Furthermore, positively chargeable electrophotographic photoconductors comprising a charge transport layer, a charge generation layer and a protective layer, which are successively overlaid on a support, containing a particular anti-oxidizing agent either in the charge generation layer or in the protective layer are proposed as described in Japanese Laid-Open Patent Applications 63-44662, 63-50848 to 63-50851, 63-52146 and 63-52150, which are capable of preventing the deterioration of the electric chargeability of the photoconductors resulting from the generation of ozone by the anti-oxidizing agent.

In these electrophotographic photoconductors, however, the anti-oxidizing effect of the anti-oxidizing agent does not last for an extended period of time while in use.

SUMMARY OF THE INVENTION

It is therefore a first object of the present invention to provide an electrophotographic photoconductor which has high environmental resistance and is not deteriorated by ozone and various ions generated by corona discharging while used repeatedly in electrophotographic copying apparatus, and capable of yielding high quality images for a long period of time.

A second object of the present invention is to provide an electrophotographic recording process by using the above-mentioned electrophotographic photoconductor.

A third object of the present invention is to provide an electrophotographic copying apparatus using the above electrophotographic recording process.

The first object of the present invention can be achieved by an electrophotographic photoconductor comprising an electroconductive support, a photoconductive layer comprising a selenium alloy formed on the support, and a protective layer, formed on the photoconductive layer, which comprises a binder resin component and an anti-oxidizing agent, and preferably can be abraded at a predetermined rate by friction or hard rubbing.

The second object of the present invention can be achieved by an electrophotographic process comprising the steps of uniformly charging the electrophotographic photoconductor in the dark, exposing the uniformly charged electrophotographic photoconductor to a light image to form an electrostatic latent image corresponding to the light image thereon, developing the latent electrostatic image with a toner to a visible toner image, transferring the visible toner image to a transfer sheet, cleaning the surface of the electrophotographic photoconductor to eliminate a residual toner from the surface thereof, if any, abrading and renewing the surface of the protective layer with a predetermined rate so as to expose the anti-oxidizing agent contained in the protective layer, and quenching residual electric charges on the surface of the photoconductor.

The third object of the present invention can be achieved by an electrophotographic copying apparatus comprising the above-mentioned electrophographic photoconductor, a charge application means for charging the surface of the photoconductor uniformly to a predetermined polarity in the dark, an exposure means for exposing the uniformly charged photoconductor to a light image to form a latent electrostatic image corresponding to the light image thereon, a development means for developing the latent electrostatic image with a toner to a visible toner image, an image transfer means for transferring the visible toner image to a transfer sheet, a cleaning means for cleaning the surface of the electrophotographic photoconductor to remove a residual toner therefrom, and an abrasion means for abrading and renewing the protective layer of the electrophotographic photoconductor with a predetermined rate during the operation of the electrophotographic copying apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
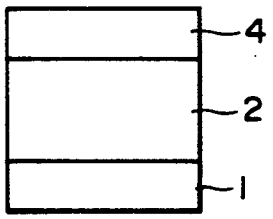
FIG. 1 is a cross-sectional view of an example of an electrophotographic photoconductor according to the present invention.

As the materials for the electroconductive support of the electrophotographic photoconductor according to the present invention, electroconductive materials, and insulating materials which are treated so as to be electroconductive can be employed. Examples of such materials are metals of Al, Ni, Fe, Cu and Au, and alloys thereof; insulating materials such as polyester, polycarbonate, polyimide and glass which are coated by a thin film of a metal such as Al, Ag and Au or an electroconductive material such as $In_2O_3$ and $SnO_2$; and a sheet of paper treated so as to be electroconductive.

There is no limitation to the shape of the electroconductive support. It can be shaped in a plate, a drum or a belt in accordance with the application thereof.

On the electroconductive support, a single-layered type photoconductive layer or a multi-layered type photoconductive layer comprising Se, or a selenium alloy such as Se-Te, $As_2Se_3$ or Se-As, is overlaid.

For preventing the mechanical wear of the above-mentioned photoconductive layer and the deposition of toner particles in the form of a film on the surface of a photoconductor (the so-called toner-filming phenomenon), a protective layer is provided on the photoconductive layer.

The protective layer for use in the present invention comprises as the main component a resin component. For example, protective layers consisting of a resin such as polystyrene, polyamide, polyester or polycarbonate, as disclosed in Japanese Patent Publications 38-015446 and 38-020697, are applicable to the present invention. In addition to this, a protective layer comprising a resin such as urethane resin, with the resistivity thereof lowered by modifying the composition thereof, as proposed in Japanese Patent Publication 52-024414, can be employed in the present invention. Furthermore, as disclosed in Japanese Laid-Open Patent Applications 57-128344, 54-121044 and 59-223442, protective layers comprising a resin such as polyurethane in which electroconductive particles such as antimony-doped tin oxide particles are dispersed to lower the resistivity thereof can be employed in the present invention.

Furthermore, polyarylate resin, epoxy resin, acrylic resin, vinyl chloride - vinyl acetate copolymer, silicone resin, alkyd resin, vinyl chloride resin and fluoroplastic may be used as the binder resin component in the protective layer.

The protective layer further comprises an anti-oxidizing agent in the present invention. Examples of the anti-oxidizing agent are phenolic compounds, sulfur compounds and phosphorus compounds. Specific examples of the anti-oxidizing agent for use in the present invention are listed below. The anti-oxidizing agents for use in the present invention are necessarily not limited to the following examples.

(I) Phenolic compounds 2,6-di-t-butyl-p-cresol (BHT), 2,6-di-t-butylphenol, 2,4-di-methyl-6-t-butylphenol, butyl hydroxyanisole, 2,2'-methylenebis(4-methyl-6-t-butylphenol), 4,4'-thiobis(3-methyl-6-t-butylphenol), bisphenol A, DL-α-tocopherol, styrenated phenol, styrenated cresol, 3,5-di-t-butyl hydroxybenzaldehyde, 2,6-di-t-butyl-4-hydroxymethylphenol, 2,6-di-s-butylphenol, 2,4-di-t-butylphenol, 3,5-di-t-butylphenol, o-n-butoxyphenol, o-t-butylphenol, m-t-butylphenol, p-t-butylphenol, o-isobutoxyphenol, o-n-propoxyphenol, o-cresol, 4,6-di-t-butyl-3-methylphenol, 2,6-dimethylphenol, 2,3,5,6-tetramethylphenol, 3-(3',5'-di-t-butyl-4'-hydroxyphenyl)-stearyl propionate, 2,4,6-tri-t-butylphenol, 2,4,6-trimethylphenol, 2,4,6-tris(3',5'-di-t-butyl-4'-hydroxybenzyl)-mesitylene, 1,6-hexanediol-bis[3-(3,5-di-t-butyl-4-hydroxyphenyl)propionate], 2,2-thio-diethylenebis[3-(3,5-di-t-butyl-4-hydroxyphenyl)propionate], 2,2-thiobis(4-methyl-6-t-butylphenol), 3,5-di-t-butyl-4-hydroxy-benzylphophatediethyl ester, 1,3,5-trimethyl-2,4,6-tris(3,5-di-t-butyl-4-hydroxybenzyl)benzene,

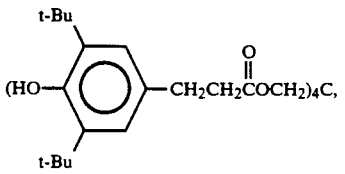

-continued

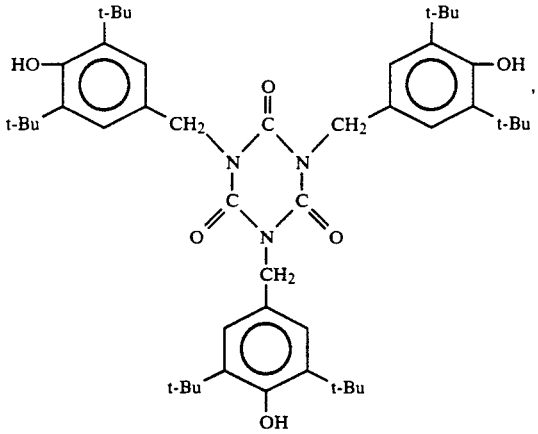

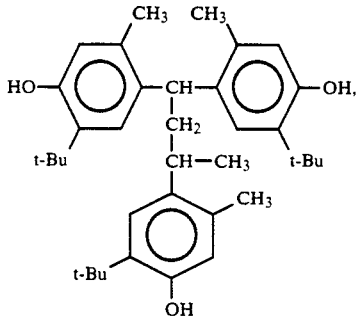

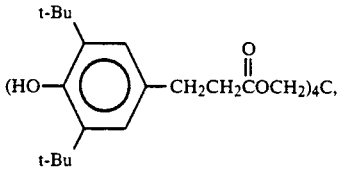

n-octadecyl-3-(3',5'-di-t-butyl-4-hydroxyphenyl)propionate, 2-t-butyl-6(3'-t-butyl-5'-methyl-2-hydroxybenzyl)-4-methylphenylacrylate, 4,4'-butylidene-bis(3-methyl-6-t-butylphenol), hydroquinone, 2,5-di-t-butyl hydroquinone, and tetramethyl hydroquinone.

These phenolic compounds can be used alone or in combination as the anti-oxidizing agents in the protective layer of the electrophotographic photoconductor according to the present invention.

(II) Sulfur compounds di-n-dodecyl 3,3'-thiodipropionate, di-myristyl 3,3'-thiodipropionate, di-n-octadecyl 3,3'-thiodipropionate, 2-mercaptobenzimidazole, pentaerythritoltetrakis-(β-lauryl thiopropionate), di-tridecyl 3,3'-thiodipropionate, dimethyl 3,3'-thiodipropionate, octadecyl thioglycollate, phenothiazine, β,β'-thiodipropionic acid, n-butyl thioglycollate, ethyl thioglycollate, 2-ethylhexyl thioglycollate, iso-octyl thioglycollate, n-octyl thioglycollate, di-t-dodecyl-disulfide, n-butyl sulfide, di-n-amyl disulfide, n-dodecyl sulfide, n-octadecyl sulfide, p-thiocresol,

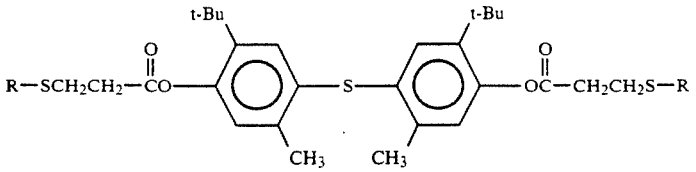

wherein R represents an alkyl group having 12 to 14 carbon atoms, and $$(C_{12}H_{25}SCH_2CH_2CH_2\overset{\overset{\displaystyle O}{\|}}{C}OCH_2)_4C.$$

These sulfur compounds can be used alone or in combination as the anti-oxidizing agent in the protective layer of the electrophotographic photoconductor according to the present invention.

(III) Phosphorus compounds

Aromatic phosphites, such as tris(nonylphenyl)-phosphite, tris(2,4-di-t-butylphenyl)phosphite, diphenyl mono(tridecyl)phosphite, tetraphenyl dipropylene glycol diphosphite, tetraphenyl tetra(tridecyl)pentaerythritol tetraphosphite, 4,4'-butylidene-bis(3-methyl-6-t-butylphenyl-di-tridecyl)phosphite, tetrakis(2,4-di-t-butylphenyl)-4,4'-biphenylene phosphite, triphenyl phosphite and tetra(tridecyl)-4,4'-isopropylidene diphenyl diphosphite; aliphatic phosphites such as trimethyl phosphite, triethyl phosphite, tri-n-butyl phosphite, trioctyl phosphite, triisodecyl phosphite, tridodecyl phosphite, tristridecyl phosphite, trioleyl phosphite and tris(2-bromoethyl)phosphite; triphenyl phosphine; trilauryl thiophosphite; tris(2-chloro-ethyl)phosphite; and distearyl pentaerythritol diphosphite.

These phosphorus compounds can be used alone or in combination as the anti-oxidizing agent in the protective layer of the electrophotographic photoconductor according to the present invention.

It is preferable that the ratio of the amount of the anti-oxidizing agent to the total amount of the resin components in the protective layer be in the range of 0.001 wt. % to 10 wt. %. If the amount of the anti-oxidizing agent in the protective layer is too small, it will not work sufficiently, but when the amount is excessive, the anti-oxidizing agent may be separated from the resin component in the protective layer if the compatibility of the anti-oxidizing agent with the resin component is poor.

In the present invention, the protective layer may further comprise a resistivity-controlling agent to obtain an electrophotographic photoconductor with an appropriate resistivity for use in practice. For example, finely-divided particles of tin oxide can be used as the resistivity-controlling agent.

In the protective layer, other additive components, such as a curing agent and a lubricant, may be further added when necessary. The curing agent is contained in the protective layer for crosslinking the resin component, and a polyisocyanate-type curing agent, for example, acrylpolyol resin is preferably employed.

It is preferable that the thickness of the protective layer for use in the present invention be in the range of 0.2 μm to 20 μm, more preferably in the range of 0.5 μm to 5 μm.

Figure 2:
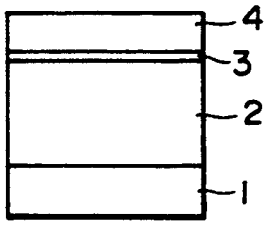
FIG. 2 is a cross-sectional view of another example of an electrophotographic photoconductor according to the present invention.

In electrophotographic photoconductors according to the present invention, a protective layer 4 is provided in such a fashion as shown in FIGS. 1 and 2.

In an electrophotographic photoconductor as shown in FIG. 1, a photoconductive layer 2 and a protective layer 4 are successively overlaid on an electroconductive support 1 in this order. Furthermore, as shown in FIG. 2, at least one intermediate layer 3 may be interposed between a photoconductive layer 2 and a protective layer 4 to increase the adhesive strength therebetween and prevent charge injection therebetween, thereby minimizing the charged potential of the photoconductor layer 2.

Examples of the materials for the above-mentioned intermediate layer 3 include a variety of polymeric organic compounds such as epoxy resin, polyester resin, polyamide resin, polystyrene resin, polyvinylidene chloride resin, polyvinyl acetate, polyvinyl chloride, acrylic resin, silicone resin and fluoroplastics; and polymeric materials prepared from (1) silane coupling agents such as trimethyl 8monomethoxy silane, γ-glycidoxy propyltrimethoxy silane and γ-methacryloxy propyltrimethoxy silane, and (2) at least one metal alkoxide or metal acetylacetone, for example, metal alkoxides such as titanium tetrabutoxide, aluminum tripropoxide and zirconium tetrabutoxide; and metal acetylacetone complexes such as titanium acetylacetonate and zirconium acetylacetonate. The above polymeric materials can be used alone or in combination.

It is preferable that the thickness of the intermediate layer for use in the electrophotographic photoconductor according to the present invention be 1 μm or less, more preferably 0.5 μm or less.

The electrophotographic copying process according to the present invention comprises the steps of uniformly charging the electrophotographic photoconductor in the dark, exposing the uniformly charged electrophotographic photoconductor to a light image to form a latent electrostatic image thereon corresponding to the light image, developing the latent electrostatic image with a toner to a visible toner image, transferring the visible toner image to a transfer sheet, cleaning the surface of the electrophotographic photoconductor to eliminate a residual toner from the surface thereof, if any, abrading the surface of the protective layer with a predetermined rate so as to expose the anti-oxidizing agent contained in the protective layer, and quenching residual electric charges on the surface of the photoconductor.

In the above electrophotographic process, the cleaning step and the abrading step can be performed simultaneously by a cleaning means which can serve as an abrading means as well.

The electrophotographic photoconductor according to the present invention, available in the form of a belt or a drum, is incorporated in an electrophotographic copying apparatus, in which there are disposed around the electrophotographic photoconductor (1) a charge application means for charging the surface of the photoconductor uniformly to a predetermined polarity in the dark, (2) an exposure means for exposing the uniformly charged photoconductor to a light image to form a latent electrostatic image corresponding to the light image thereon, (3) a development means for developing the latent electrostatic image to a visible image, (4) an image transfer means for transferring the developed visible image to a transfer sheet, (5) a cleaning means for cleaning the surface of the electrophotographic photoconductor to remove a residual developer or toner therefrom, (6) an abrasion means for abrading the protective layer of the electrophotographic photoconductor with a predetermined rate during the operation of the electrophotographic copying apparatus, and (7) a charge quenching means for quenching residual charges on the surface of the photoconductor. The cleaning means may serve as the abrasion means as well.

The key feature of the electrophotographic photoconductor according to the present invention is that the protective layer of the photoconductor contains an anti-oxidizing agent and that the anti-oxidizing agent is always present on its surface as the protective layer is abraded in the course of repeated use of the photoconductor. Thus the electrophotographic photoconductor has high environmental resistance and is not deteriorated by ozone and various ions generated by corona charging thereof while in use in an electrophotographic copying apparatus for an extened period of time.

The above-mentioned effect of the electrophotographic photoconductor according to the present invention is remarkable when it is repeatedly used in the electrophotographic copying apparatus.

By contrast, in the case of a conventional electrophotographic photoconductor with a protective layer in which an anti-oxidizing agent is contained, it has been found that the anti-oxidant action of the anti-oxidizing agent is deteriorated as the electrophotographic photoconductor is repeatedly used. For example, it was found that after the completion of making about 10,000 copies, there was substantially no anti-oxidant action in the anti-oxidizing agent. This is because the protective layer in the conventional electrophotographic photoconductor is not appropriately abraded while in use in such a manner that the anti-oxidizing agent is always present at the surface thereof.

In the present invention, the anti-oxidant effect of the anti-oxidizing agent contained in the protective layer can be sufficiently maintained by providing an abrasion means by which the surface of the protective layer is abraded at a predetermined ratio and constantly renewed while in operation of the electrophotographic copying apparatus.

Figure 4:
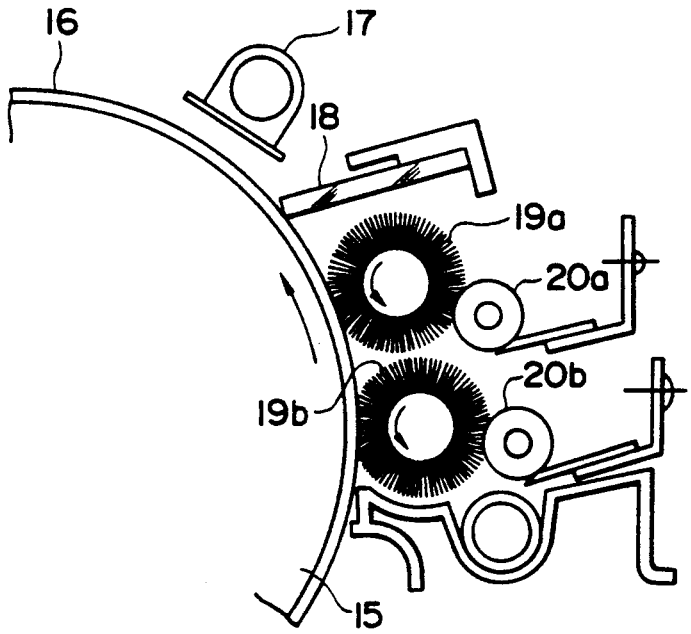
FIG. 4 is a schematic partial view of an electrophotographic copying apparatus according to the present invention.

A specific example of the abrasion means for use in the electrophotographic copying apparatus according to the present invention is shown in FIG. 4. As shown in the figure, brush members 19*a* and 19*b*, which are provided in vicinity of a photoconductor drum 15, perform the function of cleaning residual toner particles deposited on the surface of the photoconductor and abrading the surface of a protective layer 16 thereof as the photoconductor drum 15 and the brush members 19*a* and 19*b* are rotated. The brush members 19*a* and 19*b* are rotated in an opposite direction to the rotating direction of the photoconductor drum 15 at the contact point thereof and scrape the residual toner particles off the surface of the photoconductor drum 15 and abrading the surface of the protective layer 16. The toner particles are scraped off the surface of the photoconductor drum 15 by the brush members 19*a* and 19*b*, transferred thereto and then scraped off by cleaning members 20*a* and 20*b*. A blade cleaning member 18 is also provided near the photoconductor drum 1, by which residual toner particles on the photoconductor drum 15 are completely removed therefrom. Reference numeral 17 indicates a quenching lamp by which the residual electric charges on the surface of the photoconductor drum 15 are completely quenched.

The abrasion amount of the protective layer 16 of the photoconductor drum 15 can be controlled by changing the contact pressure between the brush members 19*a* and 19*b* and the protective layer 16 of the photoconductor drum 15, the rotating speed of the brush members 19*a* and 19*b* relative to that of the photoconductor drum 15, and the number of the brush members 19*a* and 19*b*. It is preferable that the abrasion rate of the protective layer 16 of the photoconductor drum 15 be 0.01 to 4 μm, more preferably 0.05 to 2 μm, in thickness per 10,000 revolutions of the photoconductor drum 15.

In the example shown in FIG. 4, the brush members 19*a* and 19*b* not only abrade the surface of the protective layer 16 but also clean the residual toner particles off the photoconductor drum 15. These two functions may be separated by using independent members.

Other features of this invention will become apparent in the course of the following description of exemplary embodiments, which are given for illustration of the invention and are not intended to be limiting thereof.

EXAMPLE 1

Formation of Photoconductive Layer

Figure 3:
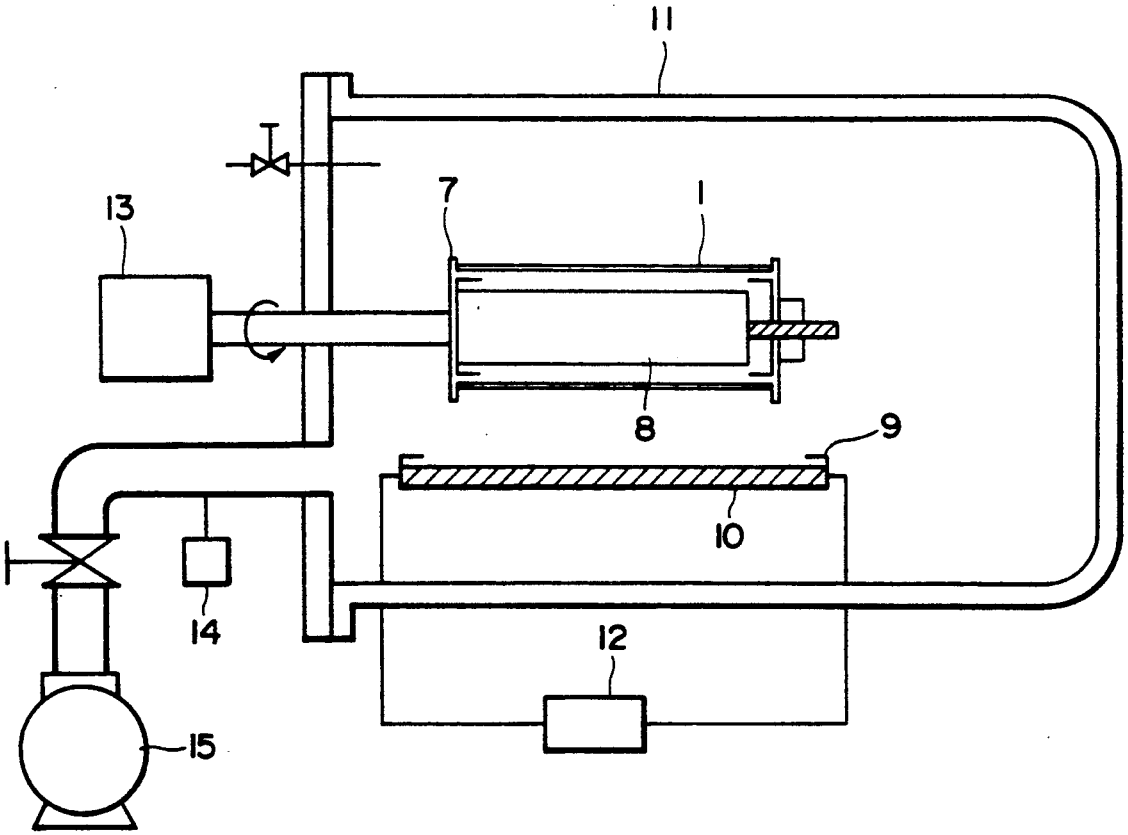
FIG. 3 is a schematic diagram of an apparatus for forming a photoconductive layer on a support by vapor-deposition.

A cylindrical electroconductive support 1 made of an aluminum alloy having an outer diameter of 80 mm and a length of 340 mm was washed and mounted on a rotatable mandrel 7 of a vacuum-deposition apparatus as shown in FIG. 3.

The vacuum-deposition apparatus shown in FIG. 3 is constructed in such a manner that the rotatable mandrel 7 is equipped with a heater 8 for heating the electroconductive support 1 and an evaporating source 9 which holds a photoconductive material 10 (in this case, an $As_2Se_3$ alloy) for forming a photoconductive layer on the electroconductive support 1 is incorporated in a vacuum chamber 11. The mandrel 7 is driven in rotation by a motor 13 which is disposed outside the chamber 11, and the evaporating source 9 is heated by a power source 12 for the evaporating source 9, which is also disposed outside the chamber 11. The chamber 11, provided with a vacuum gauge 14, is evacuated with a vacuum pump 15.

With the chamber 11 evacuated to −5 Torr or less, the evaporating source 9 was heated as the temperature of the electroconductive support 1 was maintained at 210° C., and the $As_2Se_3$ alloy in the evaporating source 9 was deposited on the electroconductive support 1. Thus, a photoconductive layer of the $As_2Se_3$ alloy with a thickness of 60 μm was formed on the electroconductive support 1.

Formation of Intermediate Layer

On the above-prepared photoconductive layer, a ligroin solution of a commercially available silicone resin, "Toray Silicone AY42-441" [Trademark), made by Toray Silicone Co., Ltd., was coated in a deposition of 0.2 μm on a dry basis, so that an intermediate layer was formed on the photoconductive layer.

Formation of Protective Layer

A mixture of the following components was dispersed, with addition of an appropriate amount of a solvent thereto, in a ball mill for 100 hours.

| | Parts by Weight |
|---|---|
| Acryl polyol (styrene-methylmethacrylate-2-hydroxyethyl methacrylate copolymer) | 15 |
| Finely-divided particles of tin oxide | 30 |
| 2,6-di-t-butyl-p-cresol | 0.2 |

To this mixture, 5 parts by weight of a polyisocyanate type curing agent was added, so that a protective layer coating liquid was obtained.

The thus obtained protective layer coating liquid was coated on the above-prepared intermediate layer, and then dried at 120° C. for 1 hour, whereby a protective layer having a thickness of about 5 μm was formed on the intermediate layer. Thus, an electrophotographic photoconductor No. 1 according to the present invention was obtained.

COMPARATIVE EXAMPLE 1

The procedure for preparation of the electrophotographic photoconductor No. 1 in Example 1 was repeated except that 2,6-di-t-butyl-p-cresol employed in Example 1 was eliminated from the composition of the protective layer coating liquid in Example 1, whereby a comparative electrophotographic photoconductor No. 1 was obtained.

For the evaluation of the thus obtained electrophotographic photoconductor No. 1 according to the present invention and comparative electrophotographic photoconductor No. 1, they were incorporated in a commercially available plain paper electrophotographic copying apparatus, "Ricopy FT6550" (Trademark), made by Ricoh Company Ltd., and subjected to a copying test by using a 5 lines/mm resolution chart.

These electrophotographic photoconductors were evaluated by visually inspecting the resolution of the obtained images.

The results are shown in Table 1.

As apparent from the results shown in Table 1, both photoconductors were capable of producing copied images with excellent resolution at the initial stage, regardless of the environmental conditions such as the temperature and humidity. After repetition of the copying operation, however, the comparative electrophotographic photoconductor No. 1 produced an image flow problem under the conditions of high humidity and the image quality was therefore considerably degraded. On the other hand, the electrophotographic photoconductor No. 1 according to the present invention yielded clear images without image flow even after 50,000 copies were made.

EXAMPLE 2

The procedure for preparation of the electrophotographic photoconductor No. 1 in Example 1 was repeated except that the composition of the protective layer coating liquid employed in Example 1 was replaced as follows, whereby an electrophotographic photoconductor No. 2 according to the present invention was obtained:

| | Parts by Weight |
|---|---|
| Acryl polyol (styrene-methylmethacrylate-2-hydroxyethyl methacrylate copolymer) | 15 |
| Finely-divided particles of tin oxide | 30 |
| 3,3'-thiodipropionic acid-di-m-dodecyl | 0.2 |

COMPARATIVE EXAMPLE 2

The procedure for preparation of the electrophotographic photoconductor No. 2 in Example 2 was repeated except that 3,3'-thiodipropionic acid-di-m-dodecyl employed in Example 2 was eliminated from the composition of the protective layer coating liquid in Example 2, whereby a comparative electrophotographic photoconductor No. 2 was obtained.

The thus obtained electrophotographic photoconductor No. 2 according to the present invention and comparative electrophotographic photoconductor No. 2 were evaluated in the same manner as in Example 1 by using a 5 lines/mm resolution chart.

The results are shown in Table 2.

TABLE 1

| | No. of Copies | | | | | |
|---|---|---|---|---|---|---|
| | At Initial Stage | | After 10,000 Copies | | After 50,000 Copies | |
| | Environmental Conditions | | | | | |
| Example No. | 20°C. 50% RH | 30°C. 90% RH | 20°C. 50% RH | 30°C. 90% RH | 20°C. 50% RH | 30°C. 90% RH |
| Example 1 | ◎ | ◎ | ◎ | ◎ | ◎ | ○ |
| Comparative Example 1 | ◎ | ◎ | ○ | x | Δ | x |

◎: resolution of 5.6 lines/mm

○: resolution of 4.5 to 5.0 lines/mm

Δ: resolution of 3.0 to 4.0 lines/mm x: resolution of 2.8 lines/mm or less

TABLE 2

| | No. of Copies | | | | | |
|---|---|---|---|---|---|---|
| | At Initial Stage | | After 10,000 Copies | | After 50,000 Copies | |
| | Environmental Conditions | | | | | |
| Example No. | 20°C. 50% RH | 30°C. 90% RH | 20°C. 50% RH | 30°C. 90% RH | 20°C. 50% RH | 30°C. 90% RH |
| Example 2 | ◎ | ◎ | ◎ | ◎ | ◎ | ○ |
| Comparative Example 1 | ◎ | ◎ | ○ | x | Δ | x |

◎: resolution of 5.6 lines/mm
○: resolution of 4.5 to 5.0 lines/mm
Δ: resolution of 3.0 to 4.0 lines/mm
x: resolution of 2.8 lines/mm or less As apparent from the results shown in Table 2, both photoconductors were capable of producing copied images with excellent resolution at the initial stage, regardless of the environmental conditions such as the temperature and humidity. After repetition of the copying operation, however, the comparative electrophotographic photoconductor No. 2 produced an image flow problem under the conditions of high humidity and the image quality was therefore considerably degraded. On the other hand, the electrophotographic photoconductor No. 2 according to the present invention yielded clear images without image flow even after 50,000 copies were made.

EXAMPLE 3

The procedure for preparation of the electrophotographic photoconductor No. 1 in Example 1 was repeated except that the composition of the protective layer coating liquid employed in Example 1 was replaced as follows, whereby an electrophotographic photoconductor No. 3 according to the present invention was obtained:

| | Parts by Weight |
|---|---|
| Acryl polyol (styrene-methylmethacrylate-2-hydroxyethyl methacrylate copolymer) | 15 |
| Finely-divided particles of tin oxide | 30 |
| Tris(2,4-di-t-butylphenyl) phosphite | 0.2 |

COMPARATIVE EXAMPLE 3

The procedure for preparation of the electrophotographic photoconductor No. 3 in Example 3 was repeated except that tris(2,4-di-t-butylphenyl)phosphite employed in Example 3 was eliminated from the composition of the protective layer coating liquid in Example 3, whereby a comparative electrophotographic photoconductor No. 3 was obtained.

The thus obtained electrophotographic photoconductor No. 3 according to the present invention and comparative electrophotographic photoconductor No. 3 were evaluated in the same manner as in Example 1. The results are shown in Table 3.

TABLE 3

| | No. of Copies | | | | | |
|---|---|---|---|---|---|---|
| | At Initial Stage | | After 10,000 Copies | | After 50,000 Copies | |
| | Environmental Conditions | | | | | |
| Example No. | 20°C. 50% RH | 30°C. 90% RH | 20°C. 50% RH | 30°C. 90% RH | 20°C. 50% RH | 30°C. 90% RH |
| Example 3 | ◎ | ◎ | ◎ | ◎ | ◎ | ○ |
| Comparative Example 3 | ◎ | ◎ | ○ | x | Δ | x |

◎: resolution of 5.6 lines/mm
○: resolution of 4.5 to 5.0 lines/mm
Δ: resolution of 3.0 to 4.0 lines/mm
x: resolution of 2.8 lines/mm or less As apparent from the results shown in Table 3, both photoconductors were capable of producing copied images with excellent resolution at the initial stage, regardless of the environmental conditions such as the temperature and humidity. After repetition of the copying operation, however, the comparative electrophotographic photoconductor No. 3 produced an image flow problem under the conditions of high humidity and the image quality was therefore considerably degraded. On the other hand, the electrophotographic photoconductor No. 3 according to the present invention yielded clear images without image flow even after 50,000 copies were made.

EXAMPLE 4

The procedure for preparation of the electrophotographic photoconductor No. 1 in Example 1 was repeated except that the composition of the protective layer coating liquid employed in Example 1 was replaced as follows, whereby an electrophotographic photoconductor No. 4 according to the present invention was obtained:

| | Parts by Weight |
|---|---|
| Acryl polyol (styrene-methylmethacrylate-2-hydroxyethyl methacrylate copolymer) | 15 |
| Finely-divided particles of tin oxide | 30 |
| 2,6-di-t-butylphenyl | 0.2 |

COMPARATIVE EXAMPLE 4

The procedure for preparation of the electrophotographic photoconductor No. 4 in Example 4 was repeated except that 2,6-di-t-butylphenyl employed in Example 4 was eliminated from the composition of the protective layer coating liquid in Example 4, whereby a comparative electrophotographic photoconductor No. 4 was obtained.

The thus obtained electrophotographic photoconductor No. 4 according to the present invention and comparative electrophotographic photoconductor No. 4 were evaluated in the same manner as in Example 1.

The results are shown in Table 4.

TABLE 4

| | No. of Copies | | | | | |
|---|---|---|---|---|---|---|
| | At Initial Stage | | After 50,000 Copies | | After 100,000 Copies | |
| | Environmental Conditions | | | | | |
| Example No. | 20°C. 50% RH | 30°C. 90% RH | 20°C. 50% RH | 30°C. 90% RH | 20°C. 50% RH | 30°C. 90% RH |
| Example 4 | ◎ | ◎ | ◎ | ◎ | ◎ | ○ |
| Comparative Example 4 | ◎ | ◎ | Δ | x | Δ | x |

◎: resolution of 5.6 lines/mm
○: resolution of 4.5 to 5.0 lines/mm
Δ: resolution of 3.0 to 4.0 lines/mm
x: resolution of 2.8 lines/mm or less As apparent from the results shown in Table 4, both photoconductors were capable of producing copied images with excellent resolution at the initial stage, regardless of the environmental conditions such as the temperature and humidity. After repetition of the copying operation, however, the comparative electrophotographic photoconductor No. 4 produced an image flow problem under the conditions of high humidity and the image quality was therefore considerably degraded. On the other hand, the electrophotographic photoconductor No. 4 according to the present invention yielded clear images without image flow even after 100,000 copies were made.

Thus, the electrophotographic photoconductors according to the present invention are not deteriorated by ozone and ions generated by the corona charging of the photoconductors even when used repeatedly for an extended period of time and capable of producing high quality images, without being affected by the environmental conditions.

What is claimed is:

1. An electrophotographic copying process comprising the steps of:

charging uniformly an electrophotographic photoconductor to a predetermined polarity in the dark, which comprises (a) an electroconductive support, (b) a photoconductive layer formed thereon comprising a selenium alloy, and (c) a protective layer, formed on said photoconductive layer, consisting essentially of a binder resin component and an anti-oxidizing agent;

exposing the uniformly charged electrophotographic photoconductor to a light image to form a latent image thereon corresponding to said light image;

developing said latent electrostatic image with a toner to a visible toner image;

transferring said visible toner image to a transfer sheet;

cleaning the surface of said electrophotographic photoconductor to eliminate residual toner from the surface thereof; and abrading the surface of said protective layer with a predetermined rate so as to expose said anti-oxidizing agent contained in said protective layer.

2. The electrophotographic copying process as claimed in claim 1, wherein said step of cleaning the surface of said electrophotographic photoconductor and said step of abrading the same are performed simultaneously.

3. The electrophotographic copying process as claimed in claim 1, wherein said electrophotographic photoconductor is in the shape of a drum or a belt and the abrasion rate of said protective layer of said electrophotographic photoconductor is in the range of 0.01 μm to 4 μm per 10,000 revolutions of said electrophotographic photoconductor.

4. The process of claim 1, further comprising the step of quenching residual electric charges on the surface of said electrophotographic photoconductor after said abrading step.

5. The process of claim 4, wherein said cleaning step and said abrading step are performed simultaneously.

6. The process of claim 4, wherein said electrophotographic photoconductor is in the shape of a drum or a belt, and the rate of abrading said protective layer is in the range of 0.01 to 4 μm per 10,000 revolutions of said electrophotographic photoconductor.

7. The process of claim 1, wherein said protective layer further consists essentially of dispersed particles which lower the resistivity of said protective layer.

8. The process of claim 7, wherein said dispersed particles are selected from the group consisting of tin oxide and tin oxide doped with antimony.

9. The process of claim 7, wherein said dispersed particles are tin oxide.

* * * * *

UNITED STATES PATENT AND TRADEMARK OFFICE

CERTIFICATE OF CORRECTION

PATENT NO. : 5,147,751

DATED : SEPTEMBER 15, 1992

INVENTOR(S) : NARIHITO KOJIMA ET AL

It is certified that error appears in the above-indentified patent and that said Letters Patent is hereby corrected as shown below:

Column 1, line 45, change "There" to --These--.

Column 9, line 28, change "extened" to --extended--.

Column 8, line 30, change "8monomethoxy" to --monomethoxy--.

Column 10, line 65, change "[Trademark)" to --(Trademark)--.

Signed and Sealed this

Twenty-fifth Day of January, 1994

*Attest:*

*Attesting Officer*

BRUCE LEHMAN

*Commissioner of Patents and Trademarks*